United States Patent [19]

Montgomery et al.

[11] Patent Number: 4,583,915

[45] Date of Patent: Apr. 22, 1986

[54] PUMP-OFF CONTROLLER

[75] Inventors: Richard C. Montgomery; G. Wayne Westerman, both of Midland, Tex.

[73] Assignee: End Devices, Inc., Midland, Tex.

[21] Appl. No.: 519,266

[22] Filed: Aug. 1, 1983

[51] Int. Cl.[4] ..... F04B 49/06; F04B 47/02

[52] U.S. Cl. ..... 417/26; 417/44; 417/53; 417/63; 73/151

[58] Field of Search ..... 417/18, 22, 44, 53; 73/151

[56] References Cited

U.S. PATENT DOCUMENTS

| | | | |
|---|---|---|---|
| 3,343,409 | 9/1967 | Gibbs | 73/151 |
| 3,930,752 | 1/1976 | Douglas | 417/12 |
| 3,951,209 | 4/1976 | Gibbs | 73/151 |
| 4,015,469 | 4/1977 | Womack | 73/151 |
| 4,034,808 | 7/1977 | Patterson | 73/151 |
| 4,062,640 | 12/1977 | Gault | 417/415 |
| 4,286,925 | 9/1981 | Standish | 417/63 |
| 4,302,157 | 11/1981 | Welton | 417/44 |
| 4,363,605 | 12/1982 | Mills | 417/44 |
| 4,487,061 | 12/1984 | McTamaney | 417/12 |
| 4,541,274 | 9/1985 | Porcupile | 417/44 |

*Primary Examiner*—William L. Freeh

*Attorney, Agent, or Firm*—Arthur F. Zobal

[57] ABSTRACT

The pump-off controller checks for pump-off by calculating the area inside of a figure whose boundaries are the minimum load, two position lines defined by the user and the load at the time the calculation is being made. This area is compared to a user defined limit to determine whether pump-off has occurred. While the well is running the controller also checks the value of the minimum load, and if it is outside of preset boundaries it readjusts the load signal to locate it within the desired range. The position synthesizer cyclically detects the position of the beam or rod during each stroke and generates a waveform whose amplitude and frequency correspond to the motion of the rod with a period corresponding to the time of each stroke. This information is used by the controller to determine the top of the stroke and to check for pump-off.

17 Claims, 18 Drawing Figures

PUMP-OFF CONTROLLER

BACKGROUND OF THE INVENTION

1. Field of the Invention

The present invention relates to a pump-off controller and a position synthesizer of a well pumping unit of the type having a walking beam which is cyclically operated by a motor for raising and lowering a polish rod of a borehole pump.

2. Description of the Prior Art

Pump-off controllers are employed for shutting down the pump of an oil well if a pumped off condition has occurred and to turn the pump back on after a reasonable waiting time. By pumped off is meant that the fluid level in the well drops such that the pump is not lifting as much fluid and hence, the amount of work done by the pump decreases. Continued pumping under pumped off conditions may result in damage to the equipment. Thus, the pump is shut down for a period sufficient to allow the fluid level to raise to a desired pumping level. The pump-off controllers also shut down the well in the event of a malfunction of the pump such as a parted rod.

In measuring the characteristics of a pumping oil well and for use by the controller it is necessary to determine the position vs. time of the polished rod and to transform this motion to an electric analog signal. For some years the only method used to generate an electric analog of position has been that of mechanically coupling the rod or beam to a potentiometer. This method is subject to frequent failure of the mechanical coupling and wear of the potentiometer.

As disclosed in the October 1979, issue of the *Journal of Petroleum Technology,* load vs. displacement measurements of the polished rod have been obtained and the area within the resulting curve used to control pump-off. This method of controlling pump-off has resulted in problems since it is sensitive to "high fluid level" distortion of the load position curve and to "bellying," a distortion sometimes associated with pump-off.

SUMMARY OF THE INVENTION

It is an object of the present invention to provide a new and useful position synthesizer and pump-off controller that avoids the above mentioned problems.

The controller checks for pump-off by calculating the area inside of a figure whose boundaries are the minimum load, two position lines defined by the user and the load at the time the calculation is being made. This area then is compared to a user defined limit to determine whether pump-off has occurred. It has been found that this procedure is relatively insensitive to "high fluid level" distortion of the load position curve, and to "bellying".

While the well is running the controller also checks the value of the minimum load, and if it is outside of preset boundaries it readjusts the load signal to locate it within the desired range. This procedure solves the problems related to thermal drift of the load or changing fluid density.

The position synthesizer cyclically detects the position of the beam or rod during each stroke and generates a waveform whose amplitude and frequency correspond to the motion of the rod with a period corresponding to the time of each stroke. Since the motion of the rod is sinusoidal, the system determines the period and highest position of the rod and calculates at any time the momentary position of the rod. This information is used by the controller to check for pump-off.

DESCRIPTION OF THE PREFERRED EMBODIMENTS

Figure 1:
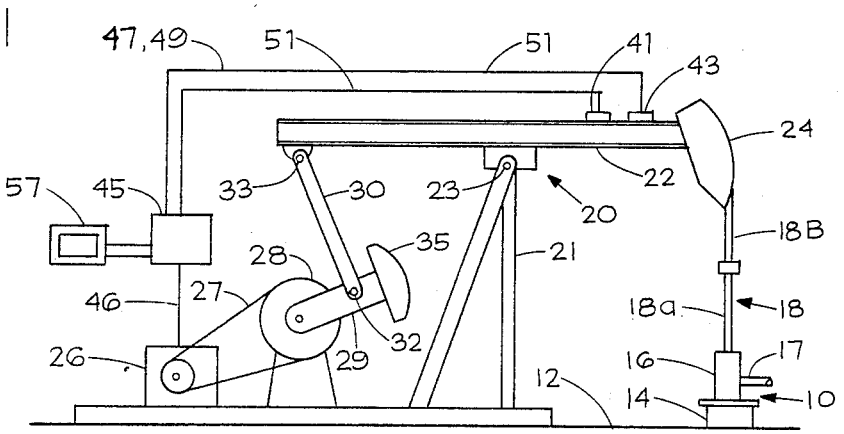
FIG. 1 illustrates a well of a beam pumping unit employing the present invention.

Referring now to FIG. 1 of the drawings, there is illustrated a well-head 10 of a well which extends from the earth's surface 12 into a subterranean oil producing formation (not shown). The wellhead comprises the upper portion of a casing string 14 and tubing string 16. The tubing string extends from the wellhead to a suitable depth within the well, i.e. adjacent the subterranean formation. Liquid from the well is produced through the tubing string 16 by means of a downhole pump (not shown) to the surface where it passes to a flow line 17.

The downhole pump is actuated by reciprocal movement of a sucker rod string 18. Rod string 18 is suspended in the well from a surface support unit 20 consisting of a Sampson post 21 and a walking beam 23 which is pivotally mounted on the Sampson post by a pin connection 23. The sucker rod string includes a polished rod section 18A which extends through a stuffing box (not shown) at the top of the tubing string and a section 18B formed of a flexible cable. The cable section 18B is connected to the walking beam 22 by means of a "horse head" 24.

The walking beam is reciprocated by a prime mover 26 comprising an electric motor. The prime mover drives the walking beam through a drive system which includes a belt drive 27, crank 28, crank arm 29, and a Pitman 30 which is pivotally connected between the crank arm and the walking beam by means of pin connections 32 and 33. The outer end of crank arm 29 is provided with a counter weight 35 which balances a portion of the load on the sucker rod string in order to provide for a fairly consistent load on the prime mover.

Figure 2:
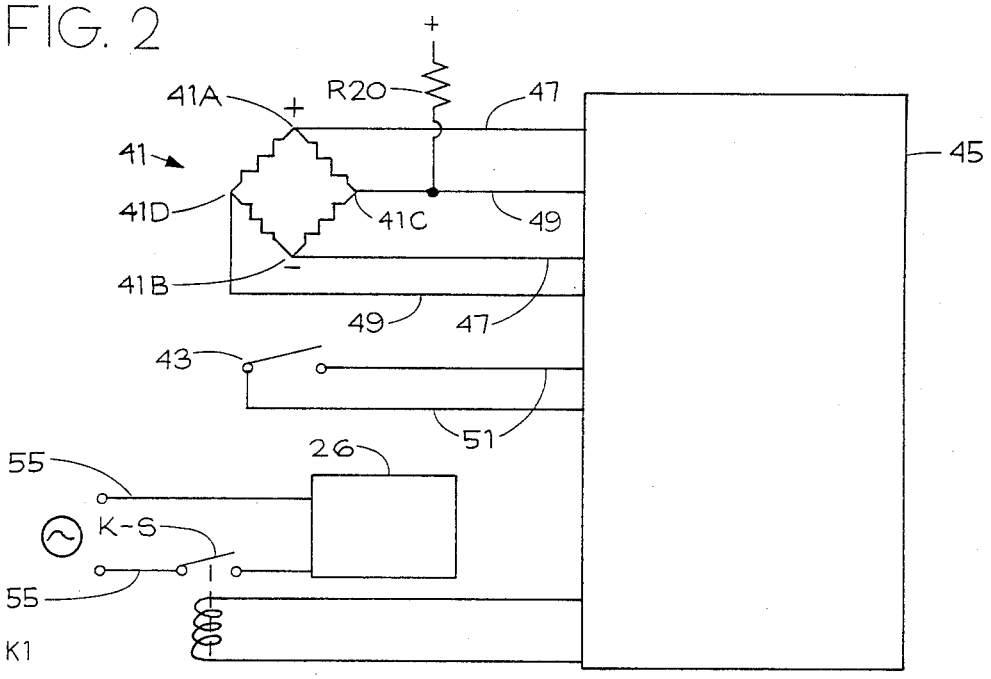
FIG. 2 illustrates in more detail the load and position detectors employed by the pump-off controller.

A load transducer 41 and a mercury switch 43 are mounted on the top of the walking beam 22. The purpose of the load transducer is to measure the load changes in the walking beam as it is driven by the prime mover 26. These load changes are proportional to the load changes on the polish rod. Preferrably the transducer 41 is an electrical bridge having strain gauges as illustrated in FIG. 2. In this embodiment, electrical power is applied to junction points 41A and 41B and a signal representative of load changes is obtained from junction points 41C and 41D. Power is supplied to the bridge 41 from a pump-off controller 45 by way of leads 47. The signal from the transducer 41 is applied back to the pump-off controller by way of leads 49. It is to be understood that other type of load transducers may be employed, for example, of the type disclosed in U.S. Pat. No. 3,965,736 which is actually clamped to the polish rod.

The mercury switch 43 is schematically illustrated in FIG. 2 and is connected to the pump-off controller 45 by way of leads 51. The purpose of the switch 43 is to detect the position of the walking beam 22 and hence the position of the polish rod 18A during its stroke as it is cyclically operated by the prime mover 26. Although the position detector preferrably is a mercury switch, it is to be understood that other types of detectors may be employed such as a magnetic proximity switch located to cyclically detect the position of the counter weight 35. The pump-off controller 45 is permanently mounted on the well. It employs the load and position as measured on and of the polish rod to shut down the prime mover 26 in the event of pump-off or malfunction of the well. The pump-off controller 45 can shut down or start the prime mover 26 by way of a relay K1 which can open or close a switch K-S connected in one of the electrical power leads 55 leading to the prime mover 26. The pump-off controller 45 also can employ the load and position as measured to obtain a load vs. position curve on an X-Y plotter illustrated at 57 in FIG. 1.

Figure 3:
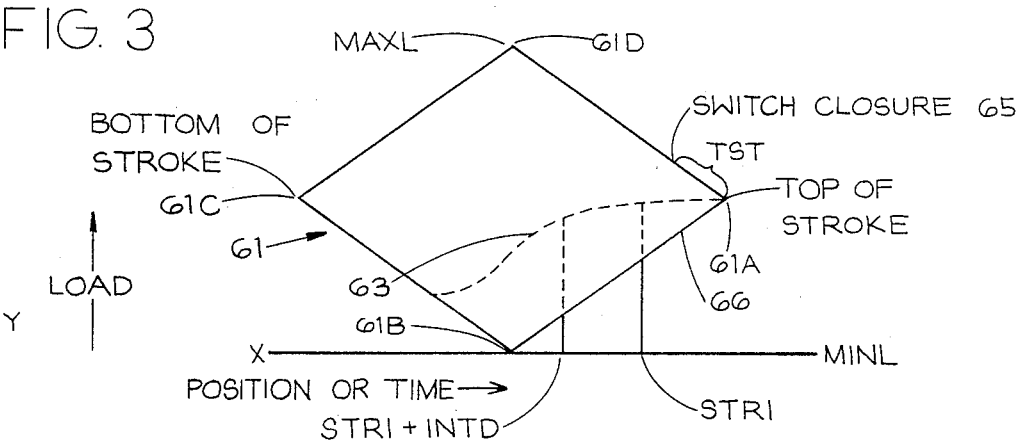
FIG. 3 is an idealized load vs. position or time curve of a polish rod useful in understanding the present invention.
Figure 4:
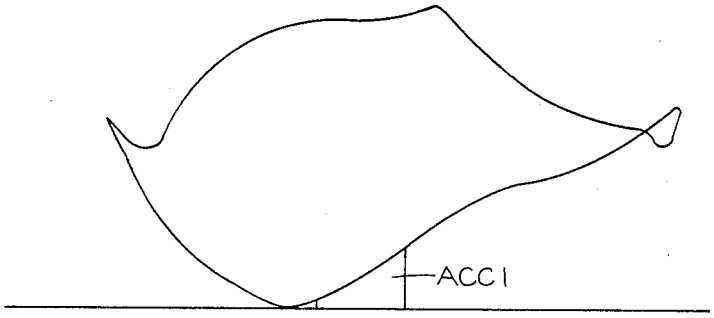
FIG. 4–6 illustrate actual load vs. position curves.
Figure 5:
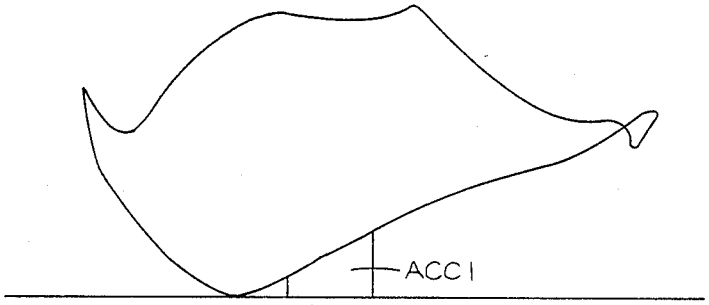
Figure 6:
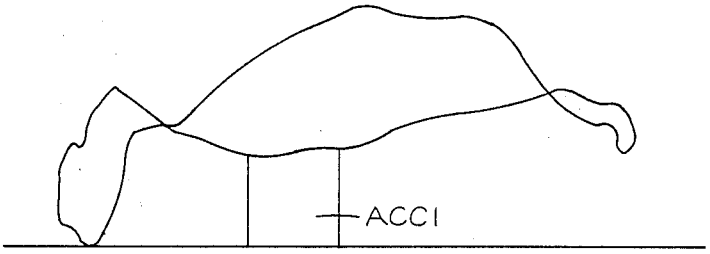

Referring now to FIG. 3 there is illustrated a curve 61 which is an idealized representation of the load on the polish rod at the surface during a complete cycle or stroke of the polish rod with no pump-off occurring. The horizontal axis represents time or position of the polish rod and the vertical axis represents load on the polish rod. The curve can be obtained with an X-Y plotter with one input being the load as measured by the transducer 41 and the other input being a sinusoidal electrical signal as obtained by the processor employing the switch 43 and representative of the position of the polish rod. FIGS. 4–6 represent actual load vs. position curves obtained during pump-off. In FIG. 3 points 61A, 61B, 61C, and 61D represent the top of the stroke, minimum load, the bottom of the stroke and maximum load respectively. The dotted portion 63 illustrates the effect that pump-off has on the load. It can be seen that the load changes during pump-off between points 61A and 61C of the curve 61. In the past, the area within the curve 61 has been measured to determine if pump-off has occurred. This process has disadvantages since in some cases during pump-off the bottom of the curve between points 61A and 61C change by what is known as "bellying" such that the area within the curve 61 remains essentially the same. Moreover problems occur if the power goes off and the well stays off for a long period of time. During this time the fluid level will build up and when the well is turned back on it has been found that the distance between points 61D and 61B of curve 61 will be decreased resulting in a flattened curve 61. The area within the curve 61 will be reduced falsely indicating pump-off.

In accordance with the present invention the occurrance of pump-off is determined by measuring the area ACCI within a figure defined by the minimum load MINL, two position lines or times defined by the user and identified at STRI and STRI+INTD and the load at the time the calculation is being made. The area ACCI can be defined mathematically as follows:

$$ACCI = \int_{STRI}^{STRI + INTD} [f(L,t) - MINL]\, dt$$

wherein:

f(L,t) represents the load curve 61 which is a function of load L and time t.

MINL is the minimum load. If MINL is set equal to zero, then the bottom of the curve 61 will be on the X axis.

The controller calculates ACCI during each stroke. For these calculations, it measures MINL during each stroke and stores this value. The beginning of integration STRI is set by the user as well as the time period of integration INTD.

The positions of STRI and STRI+INTD relative to points 61A and 61B and relative to each other as set by the user may vary from well to well. In most cases, integration within the limits STRI and STRT+INTD will be carried out during the bottom portion of the curve 61 between points 61A and 61C since this is the portion of the curve 61 that changes most during pump-off. In some cases, however, integration within the limits STRI and STRI+INTD can be carried out during the top portion of the curve between points 61C and 61D and still obtain meaningful results. In actual operation a LIMIT is set by the user and the area ACCI is calculated during each stroke and compared to the LIMIT. If ACCI becomes greater than the LIMIT, it is assumed pump-off has occurred and the well is shut down.

It has been found that changes in temperature from the sun during the day can cause the output of the transducer 41 to drift. In addition, changes in the density of the fluid in the well can cause the output of the transducer 41 to vary. In accordance with another aspect of the present invention these variations are compensated for by comparing MINL with a preset minimum limit range during each stroke and increasing or decreasing the value of the load measured depending on whether MINL is below or above the preset minimum limit range.

The switch 43 is employed to obtain information about the position of the top of the stroke. As shown in FIG. 3, the switch 43 is set to close at point 65, a known time period TST before the top of the stroke 61A is reached. The controller keys its operations to the closing of the switch 43. When the switch 43 closes, a counter STKT starts counting. The counter is monitored to determine when its count equals TST. When this occurs a second counter PTM starts counting. This counter is monitored to determine when its count equals STRI. When this occurs, integration within time period INTD begins to obtain the area ACCI. When PTM begins counting, the controller employs its count to generate a cos wave representative of the position of the polish rod as a function of time. The maximum value of the cos wave is taken to be the top of the stroke. In FIG. 3, the switch opens at point 66.

Figure 7:
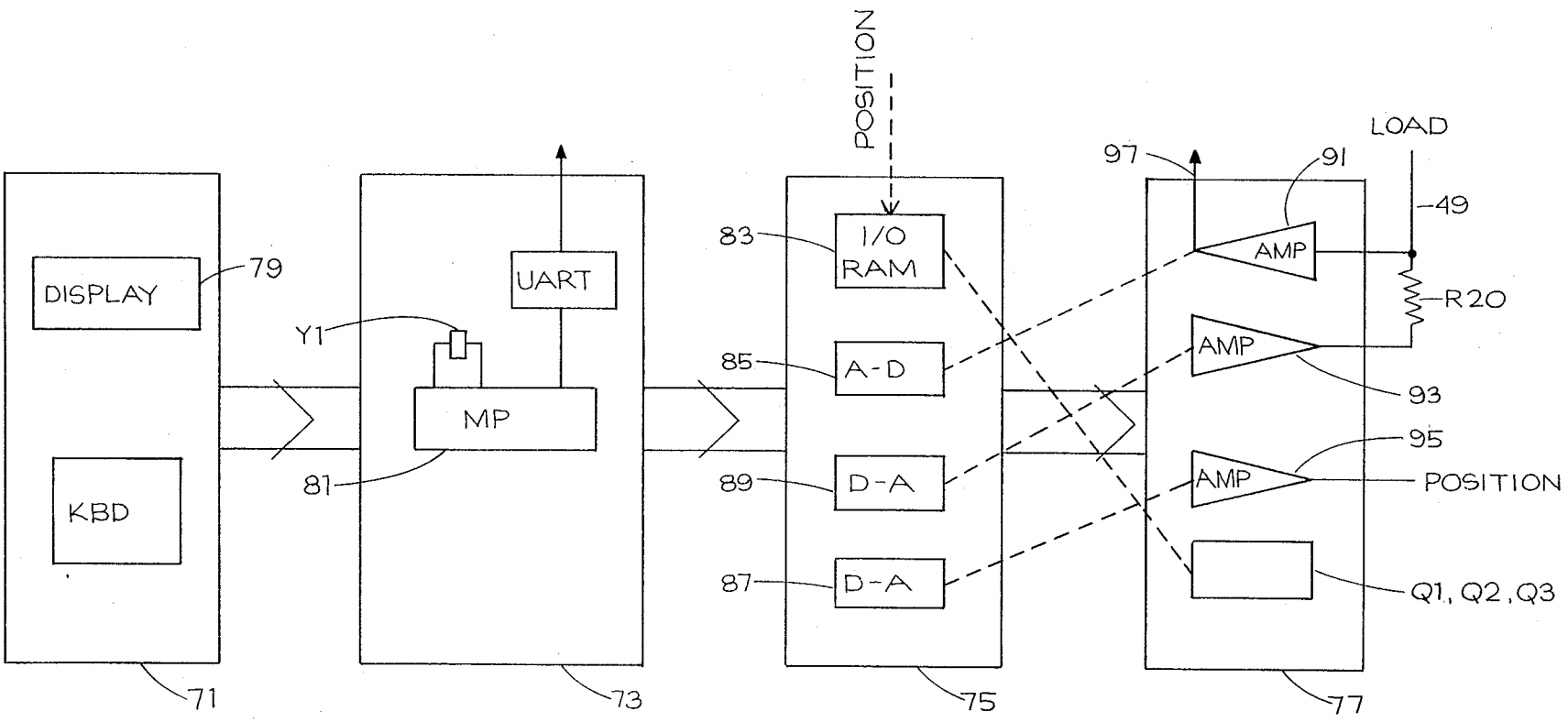
FIG. 7 is a block diagram of four printed circuit cards of the pump-off controller.

Referring now to FIG. 7, the processor comprises four printed circuit cards 71, 73, 75, and 77. The card 71 has a keyboard KBD and a digital display unit 79. The card 73 includes a microprocessor 81 and a transmitter-receiver UART. Card 71 is connected to card 73 by 16 wires. Card 75 comprises a random excess memory 83 with an input and output device I/O, an analog-to-digital converter 85 and two digital-to-analog converters 87 and 89. Card 73 is connected to card 75 by 16 wires. Card 77 includes a load amplifier 91, an auto-zero amplifer 93, a position amplifer 95 and three transistors Q1, Q2, and Q3 for controlling three relays. Q1 controls the main relay K1 for shutting down and turning on the motor of the prime mover of the pump.

The following information is entered into the keyboard KBD. When the controller shuts the well down, the number of minutes the controller should leave the well shut down before restarting is entered into the keyboard. The pump up time is entered into the keyboard. This is the number of minutes that the well should wait before it starts making measurements each time it starts up after shut down. TST, which is the time between switch closure and the top of the stroke is entered into the keyboard. STRI, which is the time from the top of the stroke to where integration is desired to begin, to obtain ACCI, is entered into the keyboard. The width or time duration of integration INTD is entered into the keyboard. The number LIMIT also is entered into the keyboard. This is the value that ACCI is compared with to determine whether pump-off has occurred for shutting the well down. Other information such as the time of day, etc., can be entered into the keyboard.

The microprocessor 81 is a commercially available microprocessor identified as a 8749 produced by Intel. It is an eight-bit microprocessor which has built into it a program capacity of 2048 bytes. It has 128 bytes of temporary storage space. Added to it are 256 bytes of temporary storage space. The microprocessor is the 40-pin chip. It is programmed by the use of a development system which electrically enters the program into the microprocessor chip. An assembly code is typed into the development system which then enters the appropriate instructions into the microprocessor chip. The UART is used to couple the microprocessor directly to a radio or telephone line. The microprocessor has an oscillator or clock Y1 coupled thereto for operation of the microprocessor and for operation of the UART.

Card 75 has a chip 83 which has 256 bytes of random access memory temporary storage. It has input and output pins I/O. Position information from the mercury switch 43 is applied to the random access memory RAM 83. The signal from the load transducer is applied to amplifier 91 which in turn is coupled to the analog-to-digital converter 85. The output of amplifier 91 also is applied to a connection 97 for connection to the X-Y plotter 57. The digital-to-analog converter 89 is connected to amplifier 93 whose output is tied to the load line 49 by way of resistor R20 for purposes of automatically zeroing (auto-zeroing) the load input. The other digital-to-analog converter 87 is tied to amplifier 95 whose output is an analog signal representative of position that is applied to the other input of the X-Y plotter. One of output pins of the random access memory 83 is tied to transistor Q1 which controls the on-off relay K-1 of the prime mover. The logic description of the program entered into the microprocessor is as follows.

LOGIC DESCRIPTION

RESET (This portion of the program is executed only when the power is turned on, and is used to initialize the processor.)
reset UART
reset RAM
enable UART clock
zero internal ram
clear display & keyboard
preset timer registers
set UART to correct message structure
preset Malfunction Limit
enable timer interrupt
jump to MAIN ISERV (timer interrupt service program)

reset timer to 25 ms.
if .1 sec has elapsed set F1 (F1 is a flag bit)
return to interrupted program KEYS (keyboard service program)

is any key pressed?
no - clear F0 and go to MAIN (F0 is a flag bit)
yes - is F0 set?
yes - to to MAIN
no - go to DEBL
DEBL - wait 20 ms. (DEBL = DE-Bounce Loop)
is key still pressed?
no - go to MAIN
yes - continue
set F0
identify which key is pressed
is entry mode set?
yes - go to DIGIT
no - go to COMD
COMD - was the key pressed "E"?
yes - go to KEE
no - continue
put the address of the data associated with this key in KR.
get the data stored at the address in KR.
display the data
to to MAIN
KEE - set to entry mode and go to MAIN
DIGIT - was the key "E"?
yes - go to DDONE
no - continue
was the number between 0 and 9?
no - display "FFFF" and go to MAIN
yes - continue
shift the number in to the rightmost digit of DP
go to MAIN
DDONE - take the number in DP and store it at the address in KR.
go to MAIN

MAIN is F1 set
no - go to KEYS
yes - go to TIME
TIME-
turn on A-D converter
read A-D converter
save reading in ADR
increment .1 sec counter
increment 1 sec counter if required
has one minute past?
no - go to TCNA
yes - go to TOD
TOD - (Time Of Day)
increment minute counter
increment hour counter if required
has 24 hours past?
no - go to TCNA
yes - continue
has the well run more than 95% in the last 24 hours?
yes - set 24 hour alarm and continue
no - continue
compute the % the well has run and store in PRT
compute the % for the last week and store in APRT
go to TCNA
TCNA -
is the external alarm input closed?
yes - turn on the alarm light and go to EXIT
no - continue -continued

LOGIC DESCRIPTION is the well turned on or off?
on - go to ONST
off - go to OFFS
EXIT -
clear F1 and go to MAIN
OFFS -
has the start button been pressed?
yes - turn the well on and go to EXIT
no - continue
has one minute past?
no - go to EXIT
yes - go to OFS1
OFS1 -
increment RNT
is the well in malfunction?
yes - go to EXIT
no - continue
is RNT > OFFT? (OFFT is the time the well stays off between cycles)
yes - turn the well on, clear RNT, and go to EXIT
no - go to EXIT
ONST -
has one minute past?
no - go to ESP
yes - continue
has .1 hour past?
no - go to ONCA
yes - increment ONT and go to ONCA
(ONT is the total run time in tenths of hours)
ONCA -
increment RNT
increment MTMR (MTMR is used in detecting Malfunctions)
ESP -
is STKT = TST?
yes - set PTM = 0
no - continue
increment PTM (PTM is the number of tenths of seconds past in the current stroke.)
multiply PTM * DPTR
(DPTR is proportional to the number of degrees per .1 sec)
look up cos(PTM*DPTR)
output to Position D-A converter
POCK
is PTM = STRI?
(STRI is the number of .1 sec after top of stroke that the area measurement begins.)
yes - set ACCI = 0
(ACCI is the area measured on this stroke)
no - continue
is STRI < PTM < STRI+INTD?
(INTD is the number of .1 sec to measure area)
yes - set ACCI = ACCI + ADR - MINL
no - continue
is it pump up time ?
yes - store ADR at RAM Location PTM
no - continue
is the well pumped off ?
yes - store ADR at RAM Location 128 + PTM
no - continue
is ADR > MAXL ? (MAXL = highest load this stroke)
yes - set MAXL = ADR
no - continue
is ADR < MINL ? (MINL = lowest load this stroke)
yes - set MINL = ADR
no - continue
increment STKT (STKT is time from position switch closure in .1 seconds)
is STKT = 256 ?
yes - set the switch not working flag
no - continue
was the switch closed the last time?
yes - go to EXIT
no - continue
is the switch closed?
no - go to EXIT
yes - continue
clear the switch not working flag
save STKT in STKM (length of stroke in .1 sec)
clear STKT
Calculate DPTR (proportional to 360/SKTM)

-continued

LOGIC DESCRIPTION check that MAXL, MINL, MAXL-MINL are within limits and if not set their respective status flags.
if MINL > limit adjust the auto-zero down.
if MINL < limit adjust the auto-zero up.
set MAXL = 0 and MINL = 255.
if the auto-zero has reached the limit of its adjustment set its status flag
are the position or load fault status flags set ?
yes - go to DEFEX
no - continue
has the pump up time past ?
no - go to EXIT
yes - continue
is the (MAXL - MINL) < MLIM flag set?
yes - go to MALC
no - continue
was the well pumped off on this stroke
no - go to EXIT
yes - continue
has the well been pumped off for the required # of strokes?
no - go to EXIT
yes - shut the well down, clear RNT, and go to EXIT
DEFEX - revert to % timer mode
is 100 * RNT / (RNT + OFFT) > APRT ?
no - go to EXIT
yes - turn well off, clear RNT, and go to EXIT
MALC - malfunction check
is MTMR > MALT?
no - go to EXIT
yes - shut the well down,
turn on the malfunction alarm
go to EXIT The logic of the computer program entered into the microprocesser MP now will be described. Referring to the RESET instructions, when power is applied to the microprocessor, it goes to location zero and finds the necessary instructions. It resets the UART and initializes it to be ready. It also initializes the RAM chip and enables the clock for the UART. The frequency of Y1 is available to the microprocessor MP and also sends the clock frequency out through UART. The microprocessor has a program and a temporary memory. All zeros are placed in the temporary memory and the display is cleared and the keyboard prepared. It presets the timers and sets UART to the type of communication it expects. In some cases, malfunction may occur such as the breakage of the polish rod. When this occurs, the curve 61 collapses and the processor shuts the well down. It uses a malfunction Limit to determine whether shutdown should occur. Accordingly, the malfunction limit is preset. The crystal Y1 operates at a frequency which is too fast for the processor. The enable timer interrupt divides that frequency down to 10 cycles a second. The program then jumps to MAIN.

The program automatically goes to ISERV (timer interrupt service program) which makes sure that at 10 times a second the microprocessor sets a flag indicating that certain things will be done in the program.

The KEYS part of the program determines whether an operator has his finger on one of the buttons and if so displays the appropriate number by way of the display device and returns back to the program.

The MAIN part of the program cycles through 10 times a second. It first determines if the flag F1 is set. If it is not set it goes to KEYS. If it is set it goes to TIME. At TIME, it turns on the analog-to-digital converter, reads the converter, and saves its reading in ADR. It increments a counter 10 times a second, checks to see if a one-second counter has been incremented and then checks to see if a minute counter has been incremented.

It next checks to see if an hour counter has been incremented. It in effect keeps track of the time of the day in minutes and hours. It then checks to see if 24 hours has gone by and if so, it determines if the well has run for more than 95% of the time in the last 24 hours. If it has, it sets a 24 hour alarm and then computes the percentage of time the well has run which is stored in PRT. It also computes the percentage of time the well has run for the last week which is stored in APRT.

At TNCA, the computer determines if an external alarm input is closed. If so, it turns on an alarm light to indicate, for example, that the pipes from the well are frozen. One of the relays is employed to turn on the alarm light. It also checks if the well is on or off instructing the program to go to ONST or to OFFS.

At EXIT, the computer clears F1 and goes back to MAIN.

One of the buttons on the keyboard that the operator can press tells the controller to turn the well on. At OFFS the computer determines if the start button has been pressed and if so turns the well on. If not, it determines if one minute has passed. If not it goes to OFSl where a counter RNT is incremented. At OFSI, RNT is used to measure the time the well is off. It then determines if the well is in malfunction. If not, it determines if RNT is greater than OFFT. OFFT is the time that the well stays off between cycles. If RNT is greater than OFFT, the well is turned on and RNT is cleared.

The controller has a counter that counts the number of tenths of an hour that the well has run. At ONST, the program determines if one minute has passed and if it has it then determines if one tenth of an hour has passed. If so, ONT is incremented. ONT is the total run time in tenths of hours.

At ONCA, RNT is incremented. At ONCA, RNT is used to measure the time that the well is on. In addition, MTMR which is used for detecting malfunctions, is incremented.

At ESP the counter STKT is checked to determine if it equals TST. If it does, counter PTM is set to equal zero and incremented. Next PTM is multiplied by DPTR which is proportional to the number of degrees per 1/10 of a second. As pointed out subsequently, DPTR is calculated as being proportional to 360/SKTM with SKTM being set to be equal to STKT. The computer has a set of cos tables. It then looks up the cos of PTM times DPTR and outputs that information to the position digital-to-analog converter 87. The cos of PTM times DPTR is a cos wave of the cycle with the maximum value occurring when the top of the stroke is reached.

At POCK, counter PTM is checked to determine if it is equal to STRI. Recall that STRI is the number of tenths of a second after the top of the stroke that the area measurement begins. If PTM is equal to STRI, then the counter ACCI is set equal to zero. Recall that ACCI is the area to be measured during each stroke. The program then determines if STRI is less than PTM which is less than STRI+INTD. Recall that INTD is the time period during which integration is to be carried out. If the answer is yes, this means that integration is taking place as MAIN cycles through ten times a second and ACCI is set equal to ACCI+ADR−MINL. Each time the program cycles through, ADR thus is added into ACCI for integration purposes until STRI+INTD is reached. ACCI thus is set equal to whatever it was previously plus the current value of ADR which is the value of the load. If STRI is not less than PTM which is not less than STRI+INTD, the computer determines if it is pump up time. If it is pump-up time, ADR is stored at RAM Location PTM. The computer then determines if the well of pumped off. If it is, ADR is stored at RAM Location 128 plus PTM.

The full scale range of the load is 0–255. MAXL is set at 0 during each stroke when the switch closes. MINL is set at 255 during each stroke when the switch closes. Next the computer determines if ADR is greater than MAXL which is the highest load this stroke. If it is, MAXL is set equal to ADR. Next the computer determines if ADR is less than MINL which is the lowest load this stroke. If so, MINL is set equal to ADR.

Next STKT is incremented and checked to determine if it is equal to 256. The controller will not control a well that has more than 255 one-tenths of a second count in a stroke which is equal to about 2 to 3 strokes a minute. If the stroke takes longer than 25.5 seconds, the controller assumes that the switch is broken.

The computer then checks to determine if the switch was closed the last time. If not it determines if the switch now is closed. If it is now closed, the switch not working flag is cleared and STKT is saved in STKM. STKT then is cleared and DPTR is calculated.

Next the computer checks to determine if MAXL, MINL and MAXL-MINL are within limits and if not, their respective status flags are set.

In terms of the full scale range 0-255, the minimum limit range has a lower limit of 25 and an upper limit of 50. The computer determines if MINL is greater than the upper limit of the minimum limit range and if so the autozero (load measured) is adjusted downward. If MINL is less than the lower limit of the minimum limit range, the auto-zero (load measured) is adjusted upward. This adjustment is obtained by applying the output of amplifier 93 to the resistor R20 which is connected to the load line indicated at 49 in FIG. 7.

MAXL is set equal to zero and MINL is set equal to 255. The action occurs at the switch closure and insures that during the following stroke any reading above zero will be checked for MAXL and any reading below 255 (full scale) will be checked for MINL. If the auto-zero has reached the limits of its adjustment, its status flag is set. The computer then checks to determine if the position or load fault status flags are set. If not it determines if the pump up time has past. If it has, it determines if MAXL-MINL is greater than the MLIM flag set. If not, the computer determines if the well was pumped off this stroke by determining if ACCI is greater than LIMIT. If the well has been pumped off, the computer then checks to determine if the well has been pumped off for the required number of strokes. If it has, it shuts the well down and clears RNT.

At DEFEX, the processor converts to a percentage timer mode which means that the well is cycled on and off for the same percentage of time that it did last week while it was running normally. The processor looks for an unacceptable position signal at "is STKT=256—yes—set the switch not working flag" and for an unacceptable load signal at "if the auto-zero has reached the limit of its adjustment, set the status flag". The processor checks to see if the position or load fault status flags are set which means that an unacceptable position or load signal has occurred. When this occurs, the computer goes to DEFEX and runs the well in the percentage timer mode. RNT is a counter that is incremented once a minute. At TCNA the processor determines if the well is on or off. If it is off, it goes to OFFS and then to OCFI and increments RNT. As the processor cycles through, it checks if RNT is greater than OFFT which is a user defined value entered into the keyboard of the processor. When RNT becomes greater than OFFT, the well is turned on and RNT is cleared. When the well is running again, and as the processor cycles through, from TCNA, the processor goes to ONST and then to ONCA and increments RNT. If the processor goes to DEFEX, RNT now is representative of the run time of the well and OFFT is the off time. APRT is the average percent run time of the well last week. APRT is calculated at TOD. At DEFEX the processor determines if the percentage run time [100·RNT/(RNT+OFFT)]now is greater than APRT. If not, the processor cycles through again maintaining the well on. When the percentage run time becomes greater than APRT, the well is turned off, RNT is cleared, and the processor cycles through while the well is off until RNT becomes greater than OFFT as checked at OFSI. When this occurs, the well is turned back on again. The processor continues to run the well in the percentage timer mode until an operating personnel comes by and turns the well off or the load signal or position signal is corrected or corrects itself.

The malfunction check MALC determines if MTMR is greater than MALT, the latter of which is a user entered number. The overall logic is, if the load range MAXL−MINL is less than a user defined value MLIM and if it remains low for more than a certain number of minutes (MALT), then shut the well off and leave it off.

Figure 8:
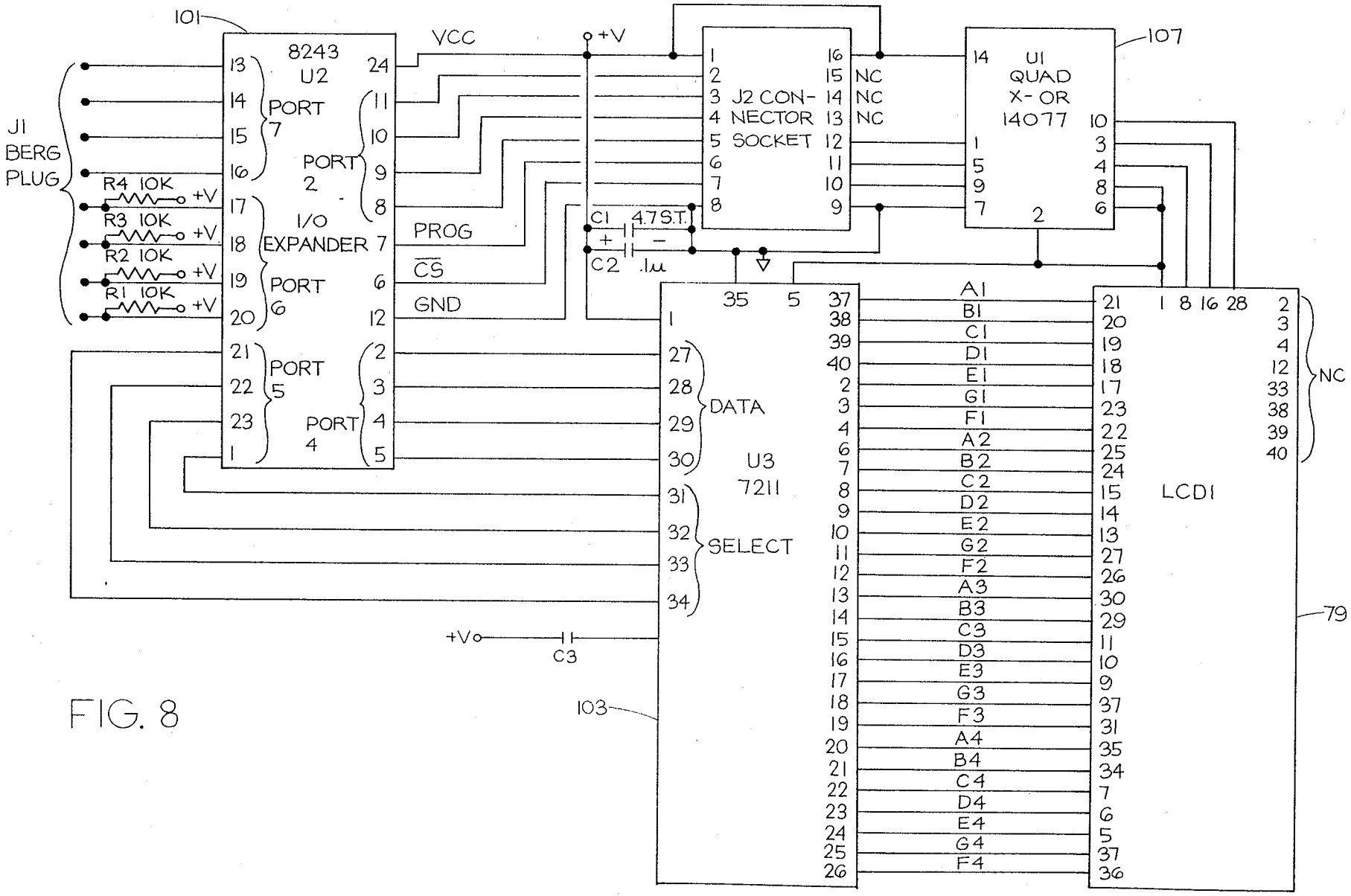
FIG. 8 is an electrical schematic of one of the printed circuit cards which contain the display and keyboard.

Referring now to FIGS. 8–18, more details of the processor will be described. Referring first to FIG. 8, the printed card 71 comprises a 24 pin integrated circuit 101 having pins 13–20 connected to push button switches which comprise the keyboard. The integrated circuit 101 also is connected to an integrated circuit 103 that translates the numbers coming from the microprocessor into the proper segments of the display unit 79. The integrated circuit 101 also is connected to a connector socket 105 that has 16 pins that are connected to the 16 pins of the microprocessor. Component 107 is a buffer that runs the decimal points in the display. Integrated circuit 101 is defined as an 8243 in the industry. Integrated circuit 103 is defined as a 7211 in the industry. Buffer 107 is defined as a Quad XR 14077 and comprises four exclusive or gates. The display 79 is a liquid crystal display.

Figures 9, 10, 11:
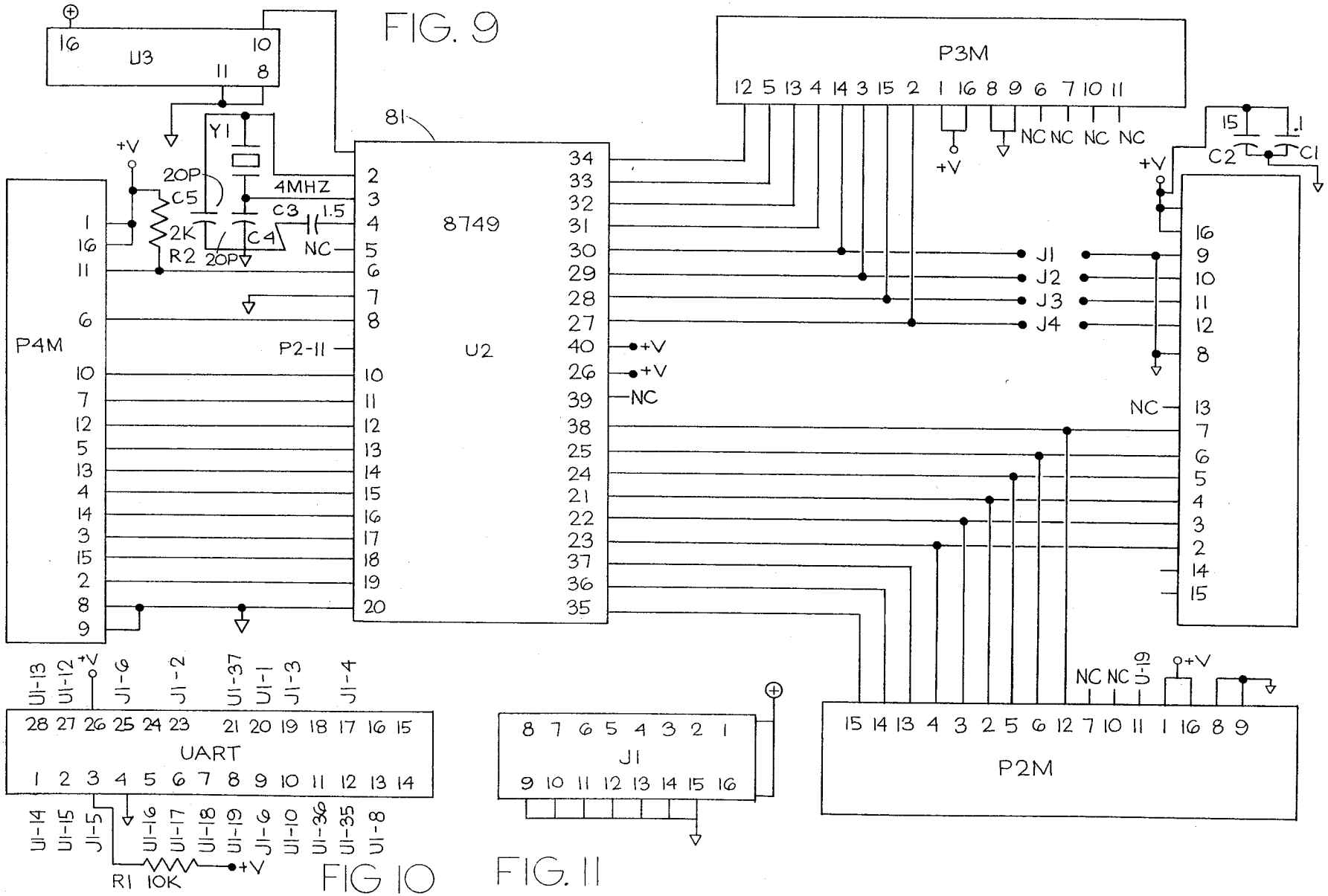
FIGS. 9, 10 and 11 are electrical schematics of the second printed circuit card that contains a microprocessor, a receiver-transmitter and a connector respectively.

Referring to FIG. 9, the microcomputer 81 has four connectors P1M, P2M, P3M, and P4M connected thereto. P1M connects to the connector socket 105 and P2M, P3M and P4M connect to the circuit of FIG. 12 which is the printed circuit card 75. These connections will be described subsequently.

In FIG. 10, the receiver transmitter UART is connected to the microprocessor 81 by the connections defined with a U1. In other words, pin U1-13 of the UART is connected to pin 13 of the microprocessor. Referring also to FIG. 11, the device illustrated is a connector which is connected to a battery, to UART and to a radio or transmission line. The connections defined with a J on the UART are connected to a battery, to UART and to a radio or transmission line. The connections defined with a J on the UART are connected to appropriate connectors of the device of FIG. 11. For example, connector Jl-6 of the UART is connected to connector 6 of the device of FIG. 11.

Figure 12:
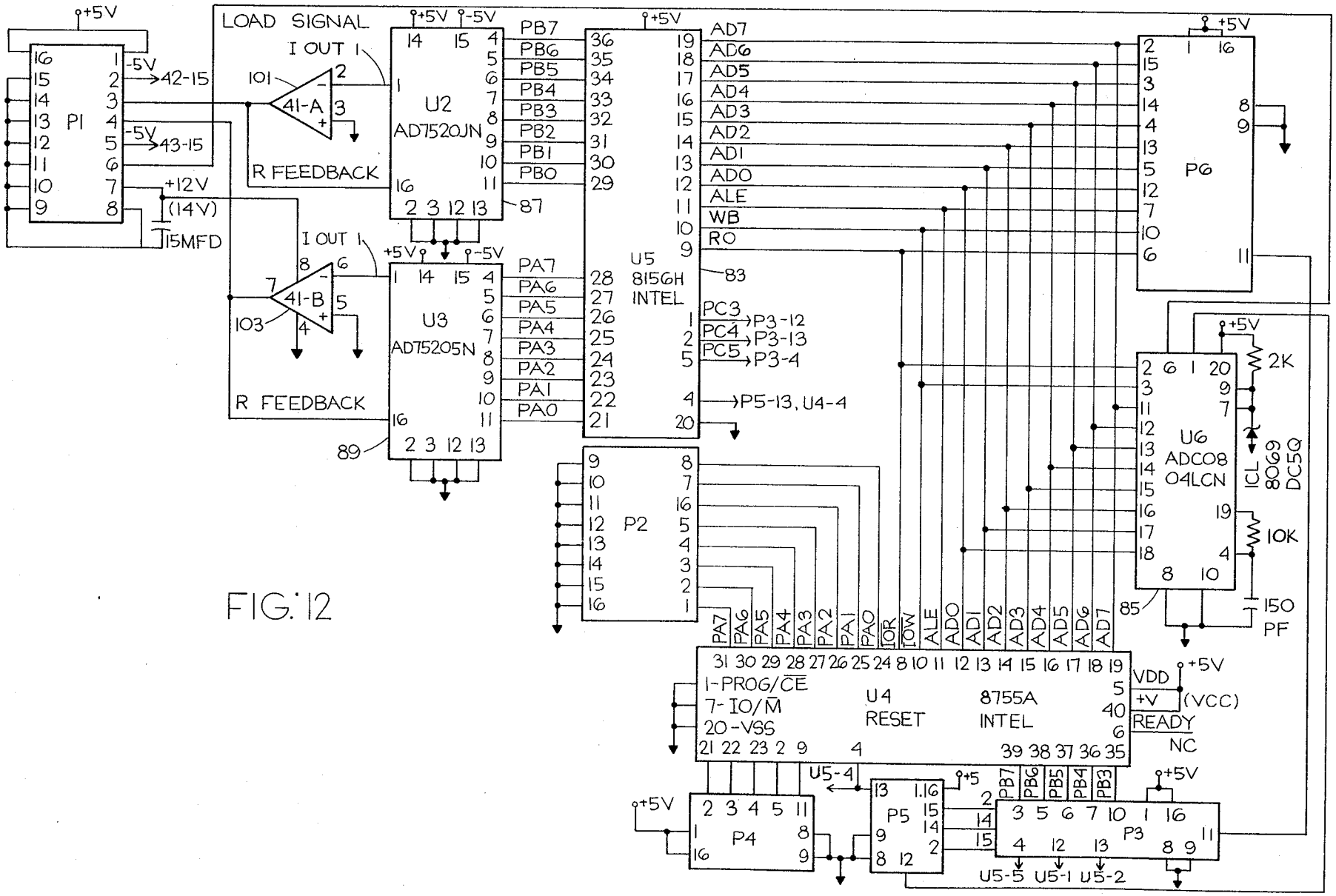
FIG. 12 is an electrical schematic of the third printed circuit card that contains a random access memory, an analog-to-digital converter and two digital-to-analog converters.

Referring to FIG. 12, P1, P2, P3, P4, P5, and P6 are connectors. 83 is the random access memory, 85 is the analog-to-digital converter and 87 and 89 are digital-to-analog converters. Components 101 and 103 are buffers or amplifiers. Connector P4M of FIG. 9 is connected to connector P6 of FIG. 12. Connector P3M of FIG. 9 connects to connector P5 of FIG. 12. Connector P2M of FIG. 9 connects to connector P4 of FIG. 12. Connector P2 of FIG. 12 is not connected to anything and the component defined as U4 is not used.

Figures 13, 14, 15, 16:
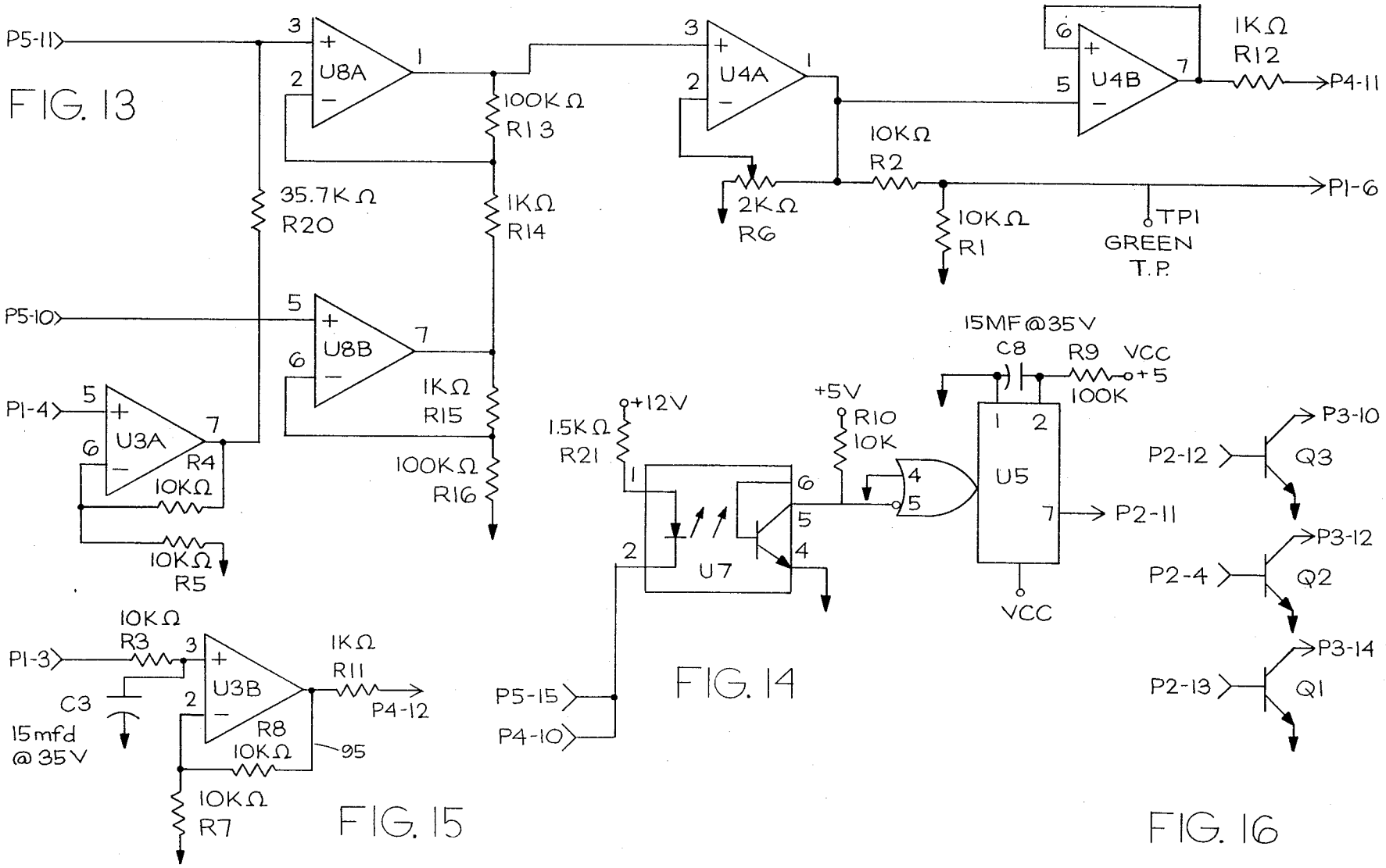
FIGS. 13–16 are electrical schematics of the fourth printed card that contains three amplifiers and relay control circuits.

Referring to FIG. 14, the output of the mercury switch 43 is applied to either of pins P5-15 or P4-10 and ground. It goes through chip U7 and out electrically on pin 5 and then goes to U5 and pin 7 which is outputted by arrow P2-11. In FIG. 14, U7 is an opto-isolator and U5 is a one-shot multivibrator. P2-11 connects to connector P3 of FIG. 12 at pin 11. This pin is connected to pin 11 of connector P6. As disclosed previously, connector P6 is connected to connector P4M of the microprocessor. Pin 11 of connector P6 is connected to pin 11 of connector P4M of the microprocessor. Pin 11 of connector P4M is connected to pin 6 of the microprocessor 81.

In FIG. 13, U5A, U5B, U4A, and U4B form the load amplifier 91. Leads 49 of the load bridge 41 are connected to pins P5-11 and P5-10. The output of the load amplifier is at pin P1-6 of U4A. Pin P1-6 of U4A connects to pin 6 of connector P1 of FIG. 12 which in turn is connected to pin 6 of the analog-to-digital converter 85. In FIG. 13, the load signal can be read separately from pin P4-11 of U4B.

In FIG. 13, U3A is the buffer for the auto-zero correction signal. Its output is connected to resistor R20. Pin P1-4 of U3A of FIG. 13 connects to pin 4 of connector P1 of FIG. 12 which is turn is connected to buffer 103 and digital-to-analog converter 89.

The position signal is applied from digital-to-analog converter 87, to amplifier 101, and to pin 3 of connector P1 which in turn is connected to pin p1-3 of amplifier 95 as shown in FIG. 15.

Referring to FIGS. 12 and 16, outputs P3-12, P3-13, and P3-4 of the random access memory 83 are connected to pins 12, 13, and 4 respectively of connector P3 which in turn are connected to inputs P2-12, P2-13 and P2-4 of transistors Q3, Q1, and Q3. These connections cause the transistors Q1, Q2, and Q3 to conduct or not to conduct depending on the situation. Transistors Q1, Q2, and Q3 connect to the three relays K1, K2, and K3 respectively of FIG. 17. The microprocessor issues orders to RAM 83 to turn the three transistors Q1, Q2, and Q3 on or off to open or close the three relays K1, K2, and K3. As mentioned previously K1 is the motor control relay which turns the well on or off. Relays K2 and K3 can be used for turning warning lights on or off.

Figure 17:
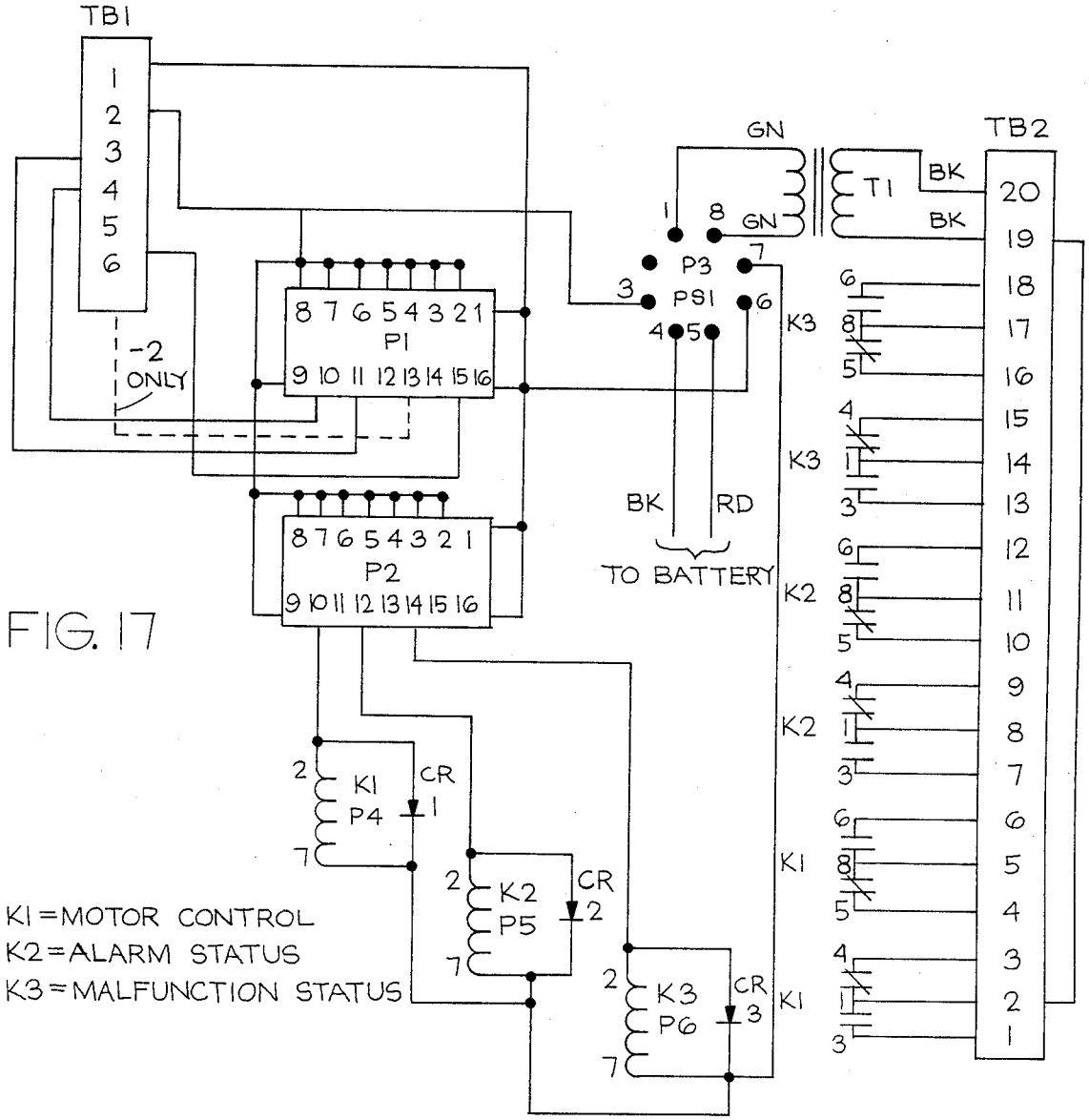
FIG. 17 is an electrical schematic of the relays.
Figure 18:
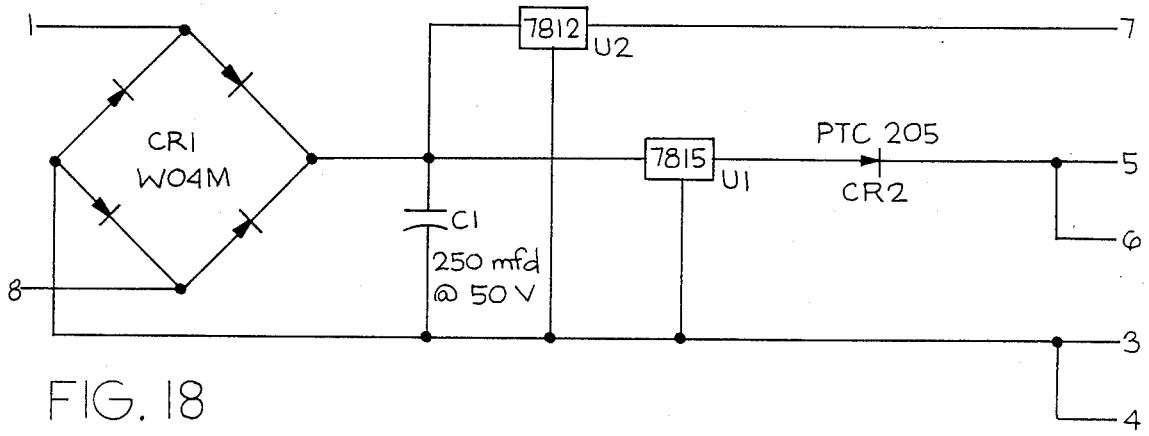
FIG. 18 is an electrical schematic of a power supply.

Referring to FIG. 17, which schematically illustrates the back panel of the controller where the wires to the outside connect, P1 and P2 are connectors, TB1 and TB2 are terminal strips, P4, P5, and P6 are sockets that K1, K2, and K3 plug into respectively and P3 in a socket that the power supply of FIG. 18 plugs into. Pins 10, 12, and 14 of connector P2 of FIG. 17 connects to the outputs P3-10, P3-12, and P3-14 of transistors Q3, Q2, and Q1 respectively and to relays K1, K2, and K3.

P1 of FIG. 17 is connected to P5-11 and P5-10 of FIG. 13. TB1 connects to the load transducer and to the position switch and TB2 connects to the power system that turns the well on and off. On TB1, pin 1 connects to the positive supply and pin 2 is connected to ground. Pins 3 and 4 are connected to the load transducer bridge leads 49. The switch 43 connects to pin 5.

We claim:

1. A process of controlling the motor of a well pumping unit of the type having a walking beam which is cyclically operated by a motor for raising and lowering a polish rod of a borehole pump, comprising the steps of:

during each cycle of the walking beam, obtaining a continuous measurement representative of the load on said polish rod, using the minimum load measured as a base, integrating the load measured during each cycle within a predetermined time period occurring as the polish rod moves from the top of its stroke to the bottom of its stroke to produce a control function, comparing said control function with a predetermined limit value, and if the value of said control function exceeds said predetermined limit value, shutting off the motor of said well pumping unit.

2. The process of claim 1, comprising the steps of:

establishing a range within which the minimum value of said measurement obtained is to be maintained, if the minimum value of said measurement obtained rises or falls above or below said range, decreasing or increasing the value of said measurement obtained respectively to maintain the minimum value of said measurement obtained within said range.

3. The Process of claim 2, wherein:

the load measured is integrated during each cycle only within the limits defined by said predetermined time period and the minimum load to produce said control function.

4. The Process of claim 1, wherein:

the load measured is integrated during each cycle only within limits defined by said predetermined time period and the minimum load to produce said control function.

5. A process of controlling the motor of a well pumping unit of the type having a walking beam which cyclically is moved upward and downward by a motor for raising and lowering a polish rod of a borehole pump, comprising the steps of:

during each cycle of the walking beam, obtaining a measurement f (L, t) representative of the load L on the polish rod as a function of time t, for each cycle of the walking beam, performing the following integrating operation to obtain a control function ACCI $$ACCI = \int_{STRI}^{STRI + INTD} [f(L,t) - MINL]\, dt$$

wherein:

STRI is the time during each cycle when integration begins,

INTD is a time period during each cycle within which integration is carried out, and MINL is the minimum load, comparing said control function with a predetermined limit value, and if the value of said control function exceeds said predetermined limit value, shutting off the motor of said well pumping unit.

6. The method of claim 5, comprising the steps of:

establishing a range within which the minimum value of said measurement obtained is to be maintained, if the minimum value of said measurement obtained rises or falls above or below said range, decreasing or increasing the value of said measurement obtained respectively to maintain the minimum value of said measurement obtained within said range.

7. The process of claim 5, wherein:

when the motor and hence the well is shut off, it is shut off for a predetermined period of time, after which it is turned on, the percentage of time the well is on is determined for a given period of time, during each cycle producing a position signal representative of a predetermined position of the walking beam and hence of the polish rod, during each cycle producing a load signal representative of the load on the polish rod, checking said position signal and said load signal and if either of said position signal or said load signal becomes unacceptable, controlling said well such that it is turned on and off to obtain the same percentage of on time as determined for said given period of time.

8. The method of claim 5, wherein:

STRI and INTD occur during each cycle between the time period that the polish rod moves from the top of its stroke to the bottom of its stroke.

9. The method of claim 8, comprising the steps of:

establishing a range within which the minimum value of said measurement obtained is to be maintained, if the minimum value of said measurement obtained rises or falls above or below said range, decreasing or increasing the value of said measurement obtained respectively to maintain the minimum value of said measurement obtained within said range.

10. The method of claim 5, wherein the beginning of the integration period is determined during each cycle by carrying out the following steps:

during each cycle producing a signal representative of a predetermined position of the walking beam, in response to said signal producing first incremented counts STKT during each cycle, comparing STKT with a fixed value TST to determine if the top of the stroke of the polish rod is reached, if the top of the stroke of the polish rod is reached, producing second incremented counts PTM, comparing PTM with a fixed value STRI to determine the beginning of the integration period, if PTM is equal to STRI determining $$ACCI = \int_{STRI}^{STRI + INTD} [f(L,t) - MINL]\, dt$$

11. The method of claim, 10 comprising the steps of:

determining 360/STKT at the end of each cycle, during the next cycle determining $$P = \cos(PTM \cdot 360/STKM),$$

and employing P and L to plot a curve representative of f(L, t) during a given cycle.

12. A system for controlling the motor of a well pumping unit of the type having a walking beam which cyclically is moved upward and downward by a motor for raising and lowering a polish rod of the borehole pump, comprising:

means for detecting the position of the walking beam during each cycle and for producing a signal representative of the position detected, means for obtaining a measurement f (L, t) representative of the load L on the polish rod as a function of time t, means for performing the following integrating operation to obtain a control function, ACCI $$ACCI = \int_{STRI}^{STRI + INTD} [f(L,t) - MINL]\, dt$$

wherein:

STRI is the time during each cycle when integration begins,

INTD is a time period during each cycle within which integration is carried out, and MINL is the minimum load, means for comparing said control function with a predetermined limit value, and means for shutting off the motor of the well pumping unit if said control function exceeds said predetermined limit value.

13. A process of controlling the motor of a well pumping unit of the type having a walking beam which is cyclically operated by a motor for raising and lowering a polish rod of a borehole pump, comprising the steps of:

during each cycle of the walking beam, obtaining a continuous measurement representive of the load on said polish rod, using the minium load measured as a base, integrating the load measured during each cycle within a predetermined time period occurring as the polish rod is cyclically operated to produce a control function, comparing said control function with a predetermined limit value, and if the value of said control function exceeds said predetermined limit value, shutting off the motor of said well pumping unit.

14. The process of claim 13, wherein;

the load measured is integrated during each cycle only within the limits defined by said predetermined time period and the minumum load to produce said control function.

15. The process of claim 13, comprising the steps of:

establishing a range within which the minimum value of said measurement obtained is to be maintained, if the minimum value of said measurement obtained rises of falls above or below said range, decreasing or increasing the value of said measurement obtained respectively to maintain the minimum value of said measurement obtained within said range.

16. The process of claim 15, wherein:

the load measured is integrated during each cycle only within the limits defined by said predetermined time period and the minimum load to produce said control function.

17. A process of operating a well pumping unit of the type having a walking beam which is cyclically operated by a motor for raising and lowering a polish rod of a borehole pump, comprising the steps of:

during each cycle of the walking beam, obtaining a measurement representative of the load on said polish rod, establishing a range within which the minimum value of said measurement obtained is to be maintained.

if the minimum value of said measurement obtained rises or falls above or below said range, decreasing or increasing the value of said measurement obtained respectively to maintain the minumum value of said measurement obtained within said range.

* * * * *